US006439132B1

(12) United States Patent
Deaver

(10) Patent No.: US 6,439,132 B1
(45) Date of Patent: Aug. 27, 2002

(54) STEEL COIL RAILROAD CAR WITH A COVER HAVING A GASKET

(75) Inventor: Ralph A. Deaver, Dickson, TN (US)

(73) Assignee: Central Sales and Service Inc., Waverly, TN (US)

( * ) Notice: Subject to any disclaimer, the term of this patent is extended or adjusted under 35 U.S.C. 154(b) by 0 days.

(21) Appl. No.: 09/274,077

(22) Filed: Mar. 22, 1999

(51) Int. Cl.[7] ..... B61D 51/00

(52) U.S. Cl. ..... 105/377.08; 105/377.08; 296/100.06

(58) Field of Search ..... 105/337.01, 337.05; 296/100.01, 100.02, 100.06, 100.07, 100.08, 100.09; 49/498.1, 483.1; 410/47; 220/806, 795, 378

(56) References Cited

U.S. PATENT DOCUMENTS 3,378,958 A * 4/1968 Parks et al. ..... 49/489
4,240,228 A * 12/1980 Okamura ..... 49/478
5,581,951 A * 12/1996 Ryan et al. ..... 49/498.1
5,618,608 A * 4/1997 Teishi ..... 428/122
5,887,392 A * 3/1999 Martin ..... 52/204.5
6,050,199 A * 4/2000 Anderson et al. ..... 105/377.07

* cited by examiner

*Primary Examiner*—S. Joseph Morano
*Assistant Examiner*—Frantz F. Jules

(57) ABSTRACT

A gasket for a steel coil railroad car wherein the gasket is contained within a U-shaped channel in the coil cover. The gasket includes a base which has a mediate section which joins opposite flanges and a bulbous portion which defines a volume. The bulbous portion has a mediate flat section that joins opposite arcuate sections. The mediate section of the base is thicker than the arcuate sections and the flat section of the bulbous portion. The gasket is retained in the U-shaped channel in such a fashion that the base contacts the mediate portion of the U-shaped channel. The gasket is compressible upon the engagement of the gasket with the railroad car so as to form a seal between the coil cover and the railroad car.

4 Claims, 4 Drawing Sheets

STEEL COIL RAILROAD CAR WITH A COVER HAVING A GASKET

BACKGROUND

The present invention pertains to a steel coil railroad car for the transport of steel coils. In particular, the invention pertains to such a steel coil railroad car which includes a cover that forms a seal (or contaminant barrier) between the coil cover and the car.

Large coils of steel are typically shipped from the steel mill to factories and steel fabricators by rail in specially-designed steel coil railroad cars. These steel coil railroad cars are of a design so as to facilitate the loading, unloading and transport of the steel coils. The objective of such a design is to minimize the potential for damage to the steel coils.

The steel coils may comprise many different types of steel. The steel coils may also range in size from 0.030 inches thick to one inch thick and in a width from four feet to seven feet. These steel coils may weight up to 20,000 pounds apiece.

The steel may be used in metal stamping, roll forming and metal fabrication of items ranging from automobiles to laboratory equipment. It is important that during the transport to the fabricator the metal (e.g., steel) be kept free from contamination due to water and/or dirt. It is especially important that the steel be kept free from rust since the steel must be able to be transported directly from the railroad car to the factory in a condition ready for fabrication. If a steel coil contains contamination (e.g., rust), the fabricator typically rejects the coil so that the steel coil must be returned to the steel mill at the expense of the carrier and/or the steel mill.

Heretofore, each steel coil railroad car has used either one coil cover to fit over the entire length of the railroad car or a pair of smaller coil covers to accommodate the length of the railroad car. Each coil cover has a U-shaped channel at its bottom edge (or lip). When the coil cover is placed on the railroad car, the U-channel fits over a square bar on the top edge of the upstanding walls of the railroad car so that the coil cover is correctly aligned and positioned on the railroad car. When the coil cover rests squarely upon the top edge a seal (or barrier) exists which protects the contents of the railroad car from contamination from the outside environment (e.g., water and/or dirt). There are, however, some problems that exist with the present coil covers.

The steel coil railroad car is made with an upward camber in the middle thereof which causes the center of the railroad car to rise higher (e.g., one-half inch) than the opposite ends thereof when the car is partially filled or empty. The presence of this camber negatively affects the existence of a seal between the coil cover and the railroad car when partially loaded or empty. In addition, fabrication tolerances can negatively impact upon the existence of an effective seal between the coil cover and the railroad car. Furthermore, metal warpage and abuse of the railroad car and the coil cover can result in the absence of an effective seal between the coil cover and the railroad car.

It can thus be appreciated that it would be advantageous to provide a steel coil railroad car that provides for the effective protection of the steel coils from contamination by water and/or dirt during transport in outside conditions which range between cold icy weather to hot steamy weather.

It would also be desirable to provide for a steel coil railroad car that provides for the effective protection of the steel coils from contamination by water and/or dirt during transport even after the railroad car, as well as the coil cover, have been subject to abuse and significant wear and metal warpage.

It would also be desirable to provide for a steel coil railroad car that provides for the effective protection of the steel coils from contamination by water and/or dirt during transport even if the railroad car is not fully loaded or empty.

SUMMARY

In one form thereof, the invention is a gasket for a steel coil railroad car wherein the gasket is contained within a U-shaped channel in the coil cover. The gasket includes a base which has a mediate section which joins opposite flanges and a bulbous portion which defines a volume. The bulbous portion has a mediate flat section that joins opposite arcuate sections. The mediate section of the base is thicker than the arcuate sections and the flat section of the bulbous portion. The gasket is retained in the U-shaped channel in such a fashion that the base contacts the mediate portion of the U-shaped channel. The gasket is compressible upon the engagement of the gasket with the railroad car so as to form a seal between the coil cover and the railroad car.

In another form thereof, the invention is a coil cover for a steel coil railroad car. The coil car comprises a cover body which has a bottom edge, and a U-channel at the bottom edge of the cover body. The coil cover further includes a gasket which comprises a base which has a mediate section which joins opposite flanges, and a bulbous portion which defines a volume. The bulbous portion has a mediate flat section that joins opposite arcuate sections. The mediate section of the base is thicker than the arcuate sections and the flat section of the bulbous portion. The gasket is retained in the U-shaped channel in such a fashion that the base contacts the mediate portion of the U-shaped channel. The gasket is compressible upon the engagement of the gasket with the railroad car so as to form a seal between the coil cover and the railroad car.

In still another form thereof, the invention is a steel coil railroad car which comprises a container portion having upstanding walls wherein the walls terminate in a top edge. The car also includes a coil cover. The coil car comprises a cover body which has a bottom edge, and a U-channel at the bottom edge of the cover body. The coil cover further includes a gasket which comprises a base which has a mediate section which joins opposite flanges, and a bulbous portion which defines a volume. The bulbous portion has a mediate flat section that joins opposite arcuate sections. The mediate section of the base is thicker than the arcuate sections and the flat section of the bulbous portion. The gasket is retained in the U-shaped channel in such a fashion that the base contacts the mediate portion of the U-shaped channel. The gasket is compressible upon the engagement of the gasket with the railroad car so as to form a seal between the coil cover and the railroad car.

BRIEF DESCRIPTION OF THE DRAWINGS

The following is a brief description of the drawings which form a part of this patent application.

Figure 1:
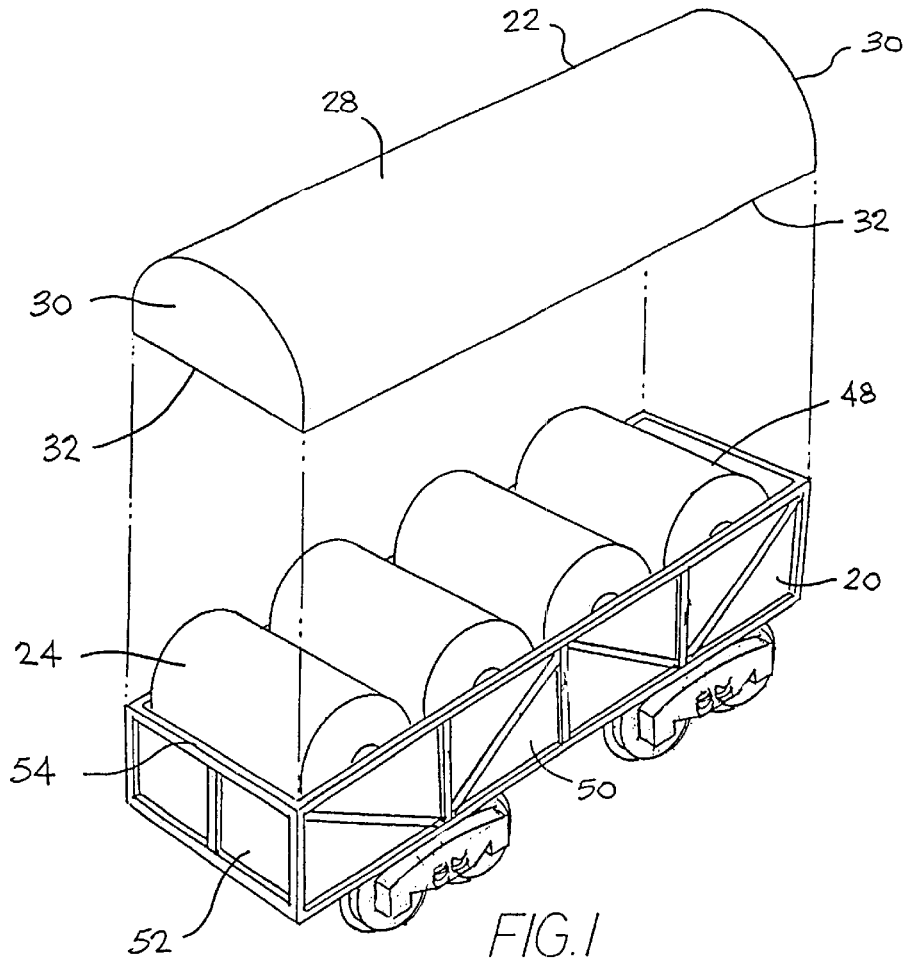
FIG. 1 is an isometric view of an embodiment of a steel coil railroad car carrying four steel coils so that the railroad car is fully loaded and having the cover of the railroad car exploded away from the top edge of the container portion of the railroad car.
Figure 8:
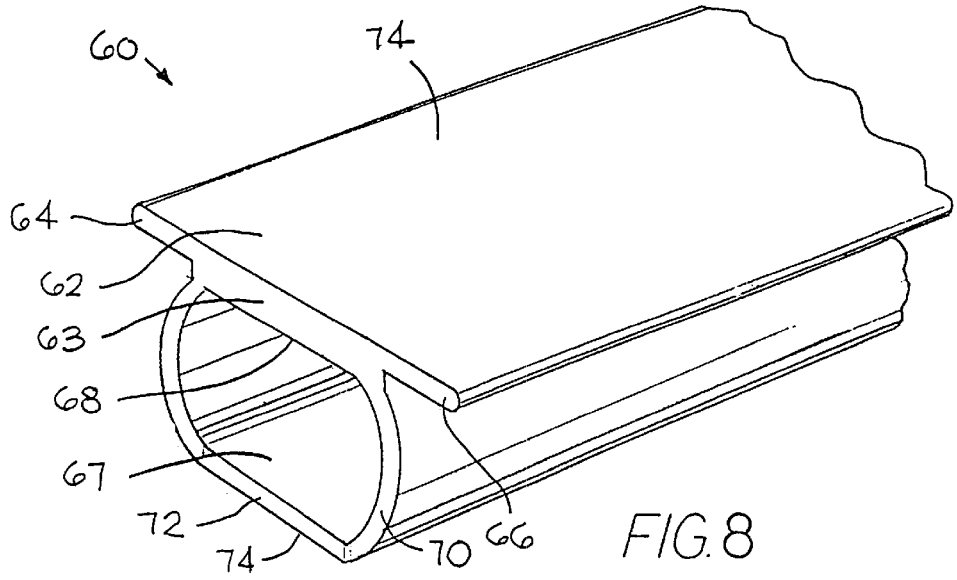
Figure 2:
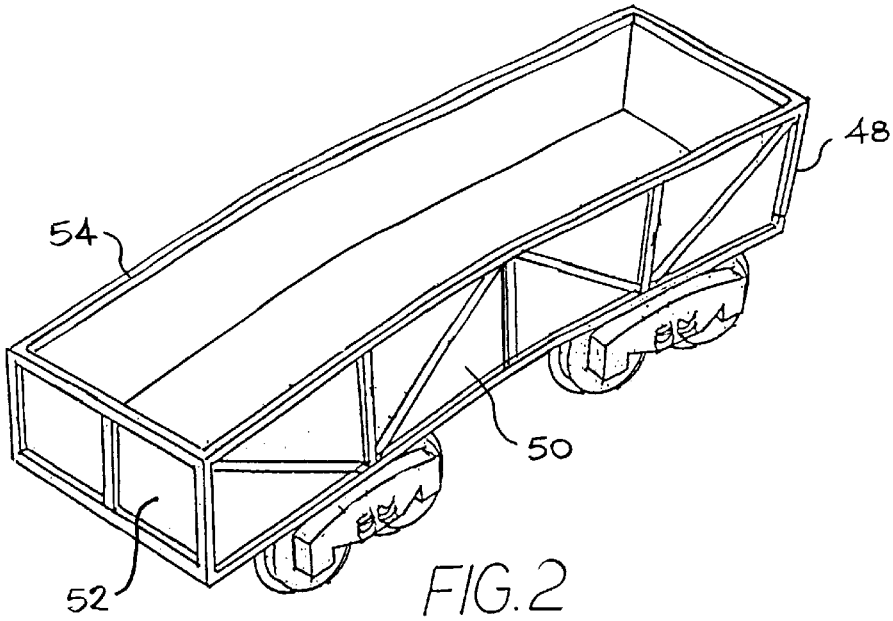
FIG. 2 is an isometric view of the container portion (without the cover) of the steel coil railroad car of FIG. 1 wherein the steel coils have been removed so that the container portion is empty and thereby illustrates the upward camber of the railroad car.
Figure 3:
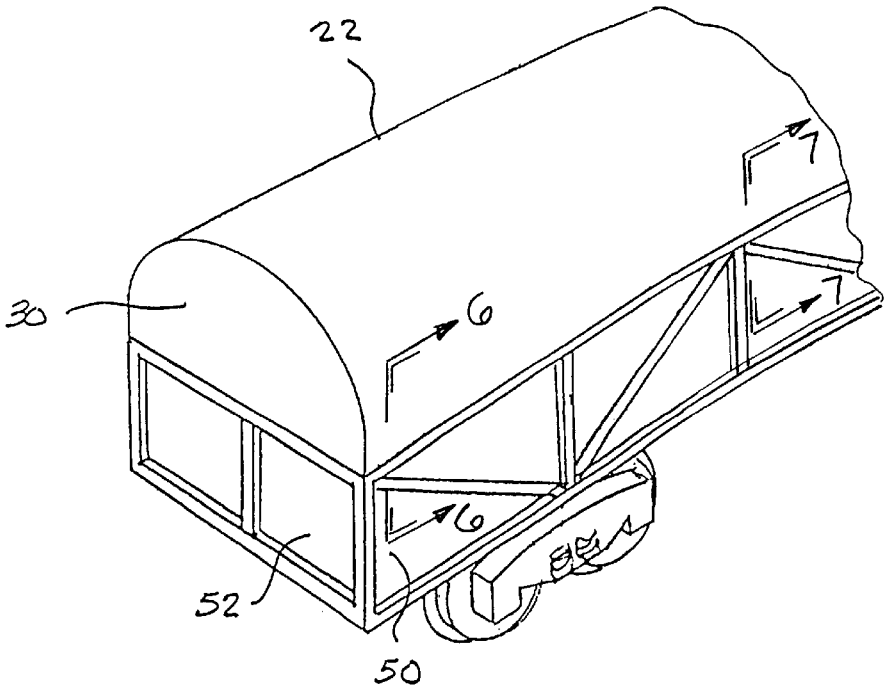
Figure 4:
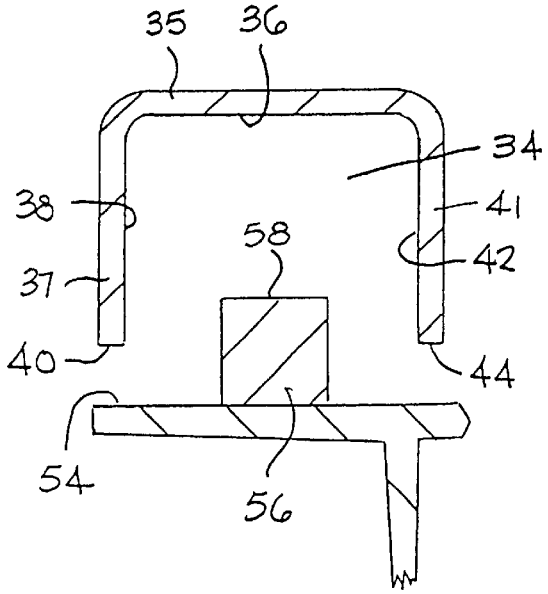
Figure 5:
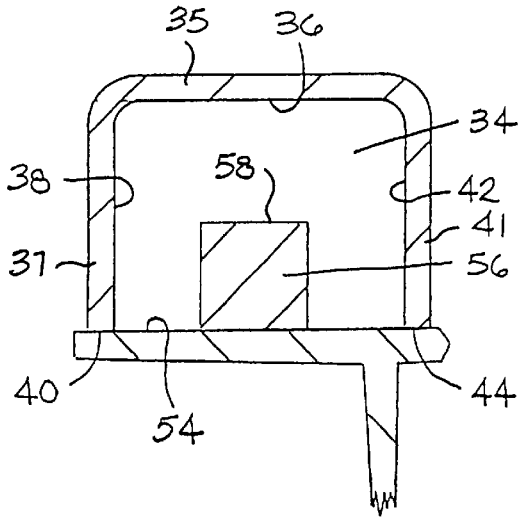
Figure 6:
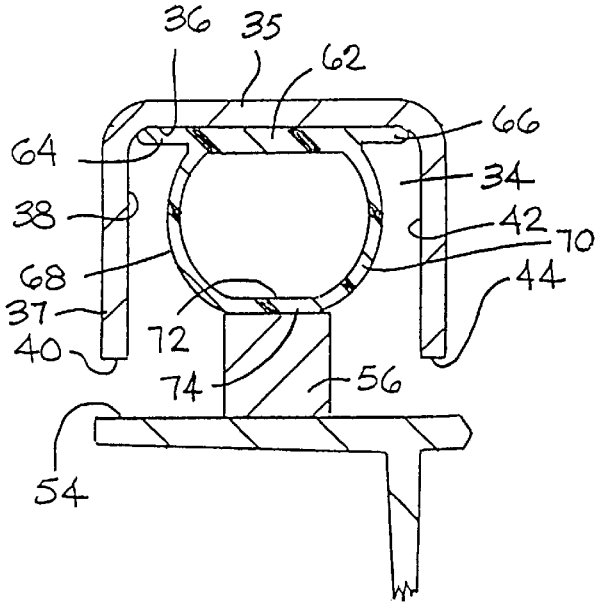
Figure 7:
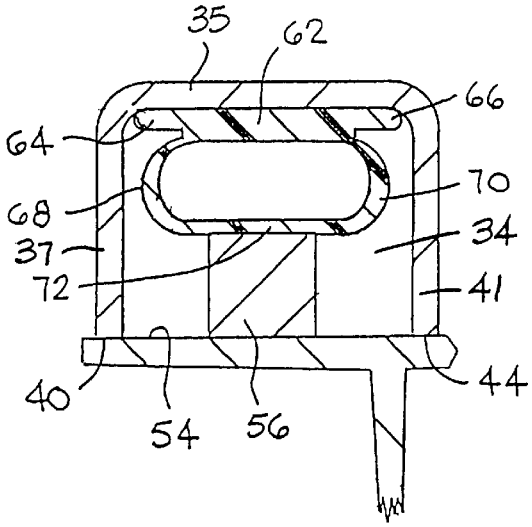
Figure 9:
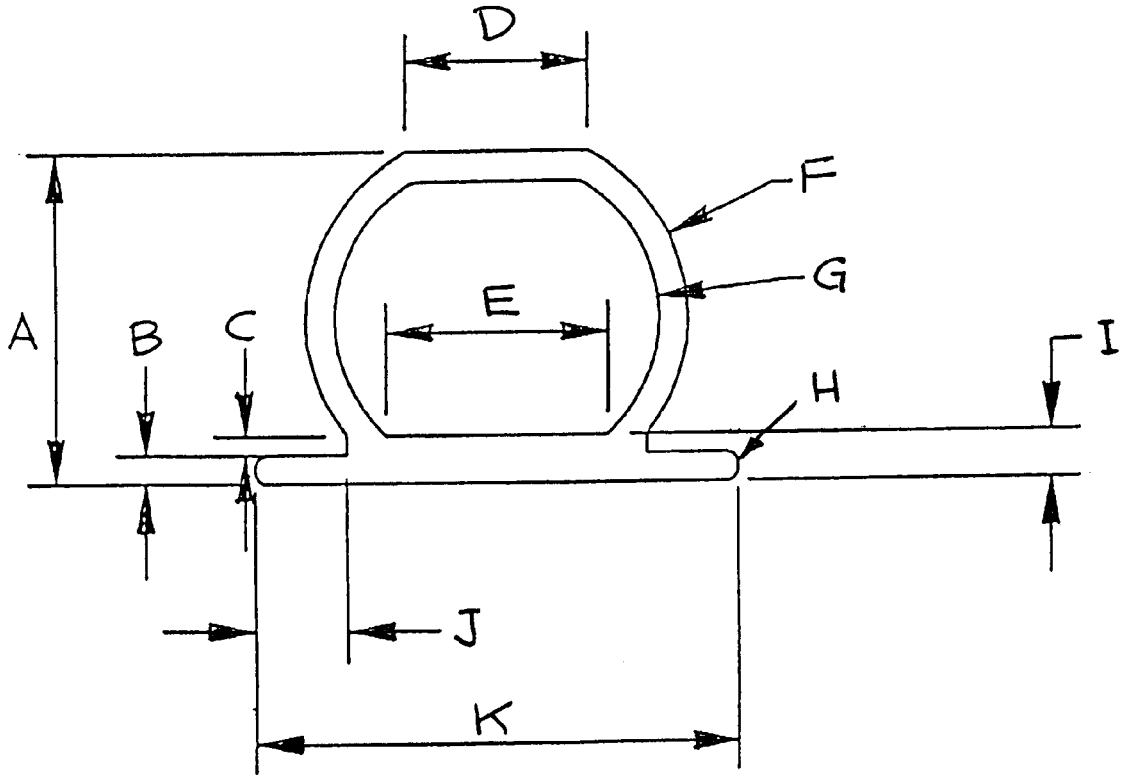

FIG. 3 is an isometric view of a portion of the steel coil railroad car with the cover thereon, but without any steel coils in the container portion thereof (i.e., the steel coil railroad car is empty);

FIG. 4 is a cross-sectional view of the juncture between the top edge of the empty container portion and the bottom edge of the coil cover (which does not have a gasket therein) adjacent one of the opposite ends of the container portion wherein at this location the bottom edge of the coil cover does not rest upon (i.e., contact) the container portion;

FIG. 5 is a cross-sectional view of the juncture between the top edge of the empty container portion and the bottom edge of the coil cover (which does not have a gasket therein) at the mid-point between the opposite ends of the container portion wherein at this location the bottom edge of the coil cover rests upon (i.e., contacts) the container portion;

FIG. 6 is a cross-sectional view taken along section line 6—6 of FIG. 3 of the juncture between the empty container portion and the coil cover, which has a gasket therein, adjacent one of the ends of the container portion whereby the gasket forms a seal between the coil cover and the top edge of the container portion of the railroad car;

FIG. 7 is a cross-sectional view taken along section line 7—7 of FIG. 3 of the juncture between the empty container portion and the coil cover, which has a gasket therein, at the mid-point between the opposite ends of the container portion whereby the U-shaped channel and the gasket each form a seal between the coil cover and the top edge of the container portion of the railroad car;

FIG. 8 is an isometric view of a section of the gasket of FIGS. 6 and 7; and FIG. 9 is a cross-sectional view showing the profile of the gasket of FIG. 8 and the dimensions of a specific embodiment of the gasket

DETAILED DESCRIPTION

Referring to the drawings, there is illustrated a specific embodiment of a steel coil railroad car 20 wherein the steel coil railroad car 20 has a single elongate cover 22. It should be appreciated that the railroad car could also use a pair of coil covers, each of which are smaller than the single coil cover 22, to accommodate the entire length of the railroad car. The railroad car 20 is shown as carrying four steel coils 24; however, it should be appreciated that the railroad car 20 may be of a design do as to carry (or accommodate) a different number of steel coils depending upon their size and weight. The steel coil railroad car may also carry a partial load of less than four steel coils. The steel coil railroad car may also from time-to-time be transported in an empty condition.

The coil cover 22 includes an upper arcuate surface 28 and has opposite flat ends 30. The coil cover 22 includes a bottom edge (or lip) 32 which defines a U-shaped channel 34. The U-shaped channel 34 has a mediate portion 35 with a mediate interior surface 36. The mediate portion 35 separates one side portion 37 (which has an interior surface 38 and a bottom edge 40) and another side portion 41 (which has an interior surface 42 and a bottom edge 44).

The steel coil railroad car 20 has a container portion 48 which has upstanding sides 50 and upstanding opposite ends 52. The upstanding sides 50 and upstanding ends 52 present a top edge surface 54. A generally square bar 56 is affixed to the top edge surface 54 wherein the square bar 56 has a top surface 58.

There is a gasket 60 which forms a seal between the coil cover 22 and the container portion 48 of the steel coil railroad car 20. The gasket 60 includes a base 62 which has a thicker (heavier) mediate portion 63 and a pair of opposite flanges 64 and 66. The mediate portion 63 is centered between the flanges (64 and 66), which are equal length, so that the gasket 60 is easily centered in the U-shaped channel 34. The presence of the flanges also provide for sufficient area to securely affix the top surface of the base to the mediate interior surface 36 of the mediate portion 35 of the U-shaped channel 34.

The gasket 60 also includes a bulbous portion 67 (or the radius body of the gasket) that extends from the base of the gasket. The bulbous portion 67 includes a pair of opposite arcuate portions 68, 70, and a flat portion 72. The flat portion 72 joins the arcuate portion 68, 70. The arcuate portions (68, 70) provide for the consistent even compression of the gasket in the confined space (or volume) of the U-shaped channel when in operation as described hereinafter. As can be seen from FIGS. 6 and 7, the gasket 60 is affixed by an adhesive or the like at its top surface to the mediate interior surface 36 of the U-shaped channel 34.

The gasket 60 may be made from a resilient material such as a dense rubber. One preferred material is an EPDM rubber compound which resists the formation of ice buildup thereon. As will be discussed hereinafter, the formation of an ice build up on the gasket may result in the destruction of the gasket. The gasket 60 may also be made in long lengths with molded corners or long molded corner wherein the gasket: lengths join in the center along the sides thereof.

Referring to FIGS. 4 and 5, these drawings illustrate the two basic types of relationships that exist between the coil cover (which does not have a gasket therein) and the top edge of the container portion 48 of the steel coil railroad car 20. More specifically, to place the coil cover on the container portion, the coil cover is positioned so that the U-shaped channel 34, which is at the bottom edge (or bottom lip) 32 fits over the square bar 56 on the top edge surface 54 of the upstanding sides (50) and ends (52) of the steel coil railroad car 20. As can be appreciated, the square bar 56 facilitates the alignment and positioning of the coil cover 22 on the top edge surface 54 of the container portion 48.

FIG. 4 illustrates the situation in which the edges (40 and 44) of the one side surface 38 and the other side surface 42, respectively, are spaced above (or apart from) the top edge surface 54. This is typically the case at those locations away from the mid point of the side walls of the container portion when the railroad car is not fully loaded or is empty. This condition typically does not occur at the juncture between the coil cover and the top edge of the container portion when the railroad car is fully loaded with steel coils. It should be appreciated that the length of the juncture where there is no contact between the coil cover and the top edge of the upstanding walls decreases as the railroad car is more fully loaded. The length of the juncture where there is no contact is the greatest when the railroad car is empty. The absence of any (or complete) contact between the coil cover and the top edge may also be due to manufacturing tolerances, metal warpage, and/or abuse of the coil cover and/or railroad car.

FIG. 5 illustrates the situation in which the edges (40 and 44) of the one side surface 38 and the other side surface 42, respectively, rest on the top edge surface 54. This is typically the case all along the juncture between the coil cover and the top edge of the container portion when the railroad car is fully loaded with steel coils. This is also the case at locations near the mid point of the side walls of the container portion when the railroad car is not fully loaded or is empty. It should be appreciated that the length of the juncture where there is contact between the coil cover and the top edge of the upstanding walls increases as the railroad car is more fully loaded.

The length of the juncture is the least when the railroad car is empty. It should also be appreciated that the existence of the contact between the coil cover and the top edge is influenced by the manufacturing tolerances, the steel warpage, and any abuse to which the coil cover and railroad car have been subjected during use.

While the above-described gasketless arrangement occasionally provides a seal (or at least a barrier to rain, snow and/or dirt), there are some disadvantages to this earlier arrangement. As mentioned in conjunction with FIG. 3, the container portion 48 of the steel coil railroad car 20 is built with an upwardly thrusting camber in the middle thereof so that when loaded the car rides flat. What this results in is the center of the container portion, which includes the side walls and top edges of the side walls, is higher (e.g., one-half inches) than the side walls at the opposite ends of the container portion. When the container portion is empty or only partially loaded, the coil cover rests upon the top edges of the sides walls such that the length of the coil cover that is near the center of the railroad car rests upon the top edge of the side walls. However, the lengths of the coil cover which are away from the center are spaced apart from the top edge. Typically, the extent of the gap between the top edges and the bottom edge of the coil cover increases from the center of the car to the opposites ends thereof.

It can be appreciated that these gaps provide for a leak path. These leak paths permit contaminants (solid and/or liquid) such as snow, rain and/or dirt, to enter into the container portion of the railroad car so as to possibly contaminate the container portion and any steel coils therein. In addition, fabrication tolerances, warpage of the metal, and/or abuse of the coil cover, as well as abuse of the railroad car, may result in the U-shaped channel 34 by itself not providing an effective seal due to the existence of a gap between the U-shaped channel and the top edges.

Referring to FIG. 3, there is shown the container portion of an empty steel coil railroad car. As discussed above, the empty steel coil railroad car has an upward camber so that the mid-point of the car is higher than the opposite ends of the railroad car. The purpose of the camber is to accommodate the weight of the steel coils when the car is fully loaded so that the car rides flat (or even). The extent of the camber may be such that the center of the car rides one-half inch above the opposite ends of the car when empty (or partially loaded). The U-shaped channel carries a gasket 60. Referring to FIG. 6, this drawing shows the relationship between the coil cover and the top edge of the side wall of the container portion taken along section line 6—6 of FIG. 3. As can be seen, the U-shaped channel does not contact to the top edge of the side wall. However, the gasket 60 provides a seal between the coil cover and the side wall. In this regard, the bottom surface 74 of the gasket 60 contacts the top surface 58 of the square bar 56 so that there is a barrier which prevents the entry of contaminants into the container portion of the railroad car. It should be appreciated that the flat surface 74 of the flat portion 72 contacts the top flat surface 58 of the square bar 56 so as to create a flat surface-to-flat surface contact. This prevents the gasket 60 from rolling to one side or the other in the U-shaped channel so that the gasket remains centered in the U-shaped channel.

Even in those situations in which the U-shaped channel 34 rests upon the top edge of the upstanding walls, the gasket 60 still provides for an effective seal between the coil cover and the top edge of the upstanding walls. This is, of course, in addition to the seal between the coil cover and the upstanding walls due to the U-shaped channel resting upon the top edge of the upstanding walls. In this regard, FIG. 7 shows the gasket 60 which forms a seal between the coil cover and the top edge of the upstanding walls when the U-shaped channel rests upon the top edge of the upstanding walls. The gasket 60 compresses under the weight of the coil cover so as to deform and yet still form an effective seal. The fact that the mediate portion of the gasket is thicker and heavier than the balance of the gasket provides for a more stable attachment to the U-shaped channel. The thicker mediate portion of the gasket eliminates rising of the center portion of the gasket when under compression so that the gasket does not become destabilized under repeated cycles of compression and expansion.

In view of the fact that the gasket rests upon the top surface of the square bar, it is advantageous if there is no ice build up on the gasket. For if there were an ice build up on the gasket, the gasket could freeze to the square bar so that upon removal of the coil cover the gasket could adhere to the square bar so as to tear loose from its attachment in the U-shaped channel. Such a situation would be very undesirable. Thus, it is advantageous that the gasket be made from a material that resists the build up of ice thereon.

Referring to FIG. 9, the following Table I sets forth the dimensions of a preferred embodiment of the gasket.

TABLE I

Dimensions of Preferred Embodiment of FIG. 9

| Dimension (see FIG. 9) | Inches |
|---|---|
| A | 1.750 |
| B | 0.150 |
| C | 0.100 |
| D | .9531 |
| E | 1.160 |
| F | 1.000 (radius) |
| G | 0.850 (radius) |
| H | 0.070 (radius) |
| I | 0.250 |
| J | .4843 |
| K | 2.530 |

It can thus be appreciated that the instant invention provides a steel coil railroad car that provides for the effective protection of the steel coils from contamination by water and/or dirt during transport. It can also be appreciated that the instant invention provides a steel coil railroad car that provides for the effective protection of the steel coils from contamination by water and/or dirt during transport even after the railroad car, as well as the coil cover, have been subject to abuse and significant wear and warpage. It can still be appreciated that the instant invention provides a steel coil railroad car that provides for the effective protection of the steel coils from contamination by water and/or dirt during transport even if the railroad car is not fully loaded or empty.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A steel coil railroad car comprising:

a container portion having upstanding walls, the upstanding walls terminating in a top edge;

a coil cover comprising:

a cover body having a bottom edge, a U-channel at the bottom edge of the cover body;

a gasket comprising:

a base having a mediate section which joins opposite-flanges;

a bulbous portion defining a volume, the bulbous portion having a mediate flat section that joins opposite arcuate sections;

the mediate section of the base being thicker than the arcuate sections and the flat section of the bulbous portion;

the gasket being retained in the U-shaped channel in such a fashion that the base contacts the mediate portion of the U-shaped channel; and the gasket being compressible upon the engagement of the gasket with the railroad car so as to form a seal between the coil cover and the railroad car.

2. The steel coil railroad car of claim 1 wherein the arcuate sections of the gasket provide for the even consistent compression of the gasket when placed under a load.

3. The steel coil railroad car of claim 1 wherein each once of the flanges extends an equal distance away from the mediate section of the base.

4. The steel coil railroad car of claim 1 wherein the seal between the coil cover and the railroad car is at the mediate flat section of the bulbous portion of the gasket.

* * * * *